United States Patent [19]

Carroll, Jr.

[11] 4,132,242

[45] Jan. 2, 1979

[54] CHEMICAL DISTRIBUTION SYSTEM

[76] Inventor: John D. Carroll, Jr., 182 Pleasant St., Paxton, Mass. 01612

[21] Appl. No.: 853,102

[22] Filed: Nov. 21, 1977

Related U.S. Application Data

[63] Continuation of Ser. No. 660,457, Feb. 23, 1976, abandoned.

[51] Int. Cl.[2] ..... F17D 3/00

[52] U.S. Cl. ..... 137/263; 68/207; 137/389; 137/391; 137/403; 137/558; 137/571; 222/61; 222/63; 417/38

[58] Field of Search ..... 68/207; 137/386, 387, 137/389, 391, 393, 396, 403, 406, 211, 571, 551, 558, 255, 263, 390; 222/56, 58, 63, 318, 61; 417/38, 44

[56] References Cited

U.S. PATENT DOCUMENTS

| | | | |
|---|---|---|---|
| 1,700,362 | 1/1929 | Atwell | 137/263 |
| 2,381,505 | 8/1945 | Lindholm | 222/56 |
| 2,412,107 | 12/1946 | Tannehill | 417/44 |
| 2,885,879 | 5/1959 | Bloom | 137/403 |
| 2,956,581 | 10/1960 | Pearson | 417/38 |
| 3,002,460 | 10/1961 | Ward | 417/44 |
| 3,397,716 | 8/1968 | Andersson | 137/406 |
| 3,670,533 | 6/1972 | Worst | 137/387 |
| 3,773,065 | 11/1973 | Mattox | 137/263 |
| 3,891,123 | 6/1975 | Blackburn | 137/571 |

FOREIGN PATENT DOCUMENTS

| | | | |
|---|---|---|---|
| 535413 | 4/1922 | France | 417/44 |
| 717331 | 10/1954 | United Kingdom | 417/44 |

*Primary Examiner*—Martin P. Schwadron
*Assistant Examiner*—G. L. Walton
*Attorney, Agent, or Firm*—Norman S. Blodgett; Gerry A. Blodgett

[57] ABSTRACT

Chemical distribution system having a pressurized tank for causing flow of chemical to a plurality of appliances and having an apparatus for introducing a chemical into the tank from bulk storage and maintaining the pressure at a constant, predetermined value.

6 Claims, 1 Drawing Figure

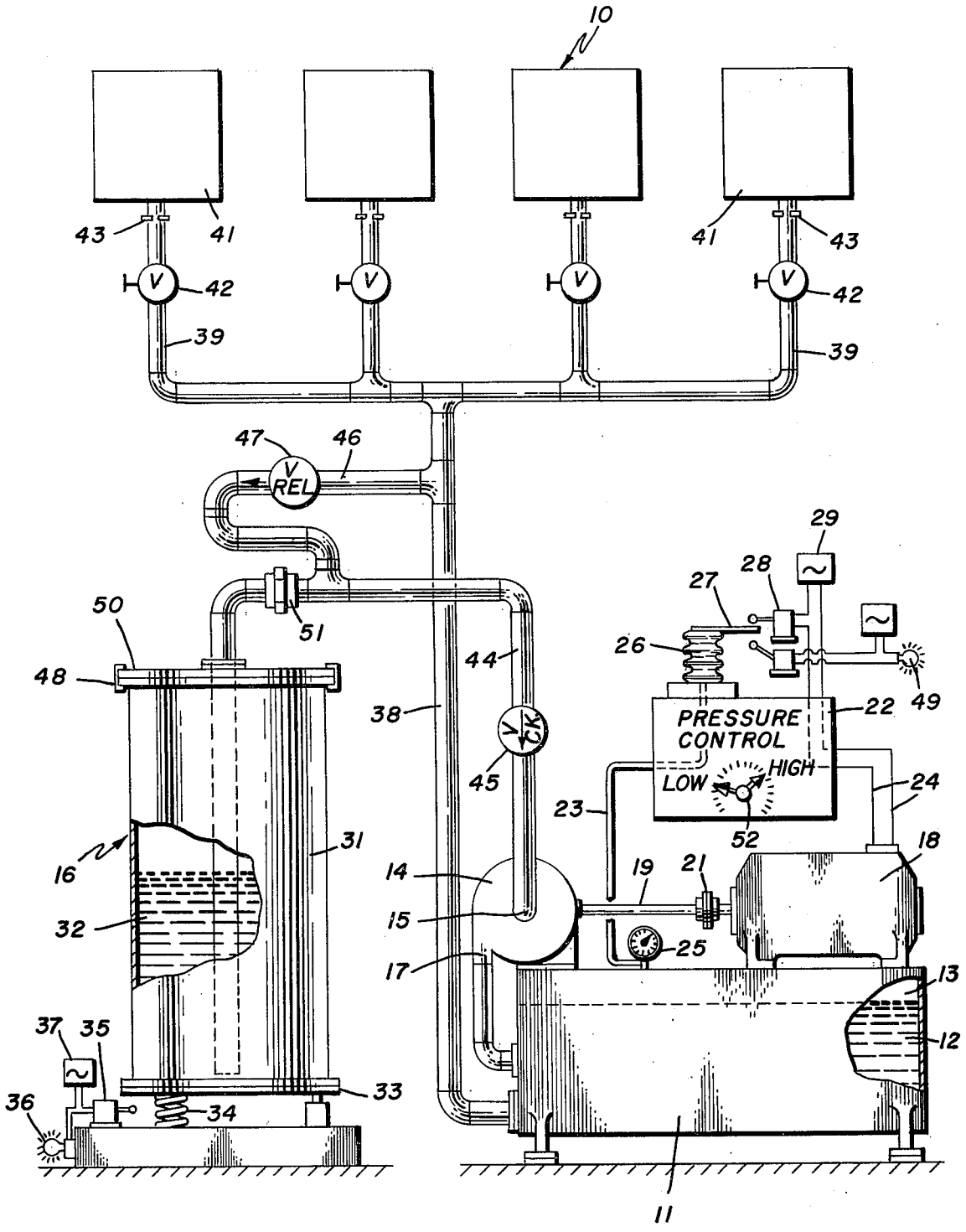
10
43
41
41
43
V
42
V
V
V
42
39
39
47
46
V
REL
29
28
27
26
50
51
44
48
38
V
CK
45
PRESSURE
CONTROL
LOW
HIGH
22
49
24
23
52
18
16
31
14
19
21
32
15
25
17
13
12
37
35
33
36
34
11

CHEMICAL DISTRIBUTION SYSTEM

This is a continuation of application Ser. No. 660,457 filed Feb. 23, 1976, now abandoned.

BACKGROUND OF THE INVENTION

In the operation of a commercial laundry, it is necessary to introduce chemicals such as soap and detergent into each of a plurality of washing machines. Although these machines have automatic machinery for introducing the chemical into the wash water at various parts of the washing cycle, it has been necessary in the past to load the chemicals into the automatic machinery by hand. In addition to the obvious disadvantage of this method of operation, due to the high cost of manual labor, there is also a disadvantage in the fact that the washing machines operate on cycles of different length, which means that on occasion a plurality of machines will need to have their automatic machinery loaded at the same time with chemical. Since the attendant can only load one machine at a time, there is a strong possibility that one of the machines will be idle at a given time which, of course, represents a loss because its share of the capital amortization. In addition, a manual loader or attendant will sometimes forget to load chemicals into a given washing machine, so that the machine can pass through an entire wash cycle before it has been discovered that the cleaning agent or the like did not take part in the washing operation. Attempts have been made in the past to provide automatic chemical distribution systems to solve this problem, but they have all been very expensive and they have been easily rendered out of order due to the generally corrosive nature of the chemicals which they handle. They have also suffered from the difficulty that, when the storage hopper becomes empty, there is a gap in the flow of chemicals to the machines until such time as the hopper can be reloaded. These and other difficulties experienced with the prior art devices have been obviated in a novel manner by the present invention.

It is, therefore, an outstanding object of the invention to provide a chemical distribution system for serving chemicals at a predetermined pressure to a plurality of appliances.

Another object of this invention is the provision of a distribution system for providing soap and the like to a plurality of commercial washing machines, so that the automatic feed mechanisms of the machine are full at all times.

A further object of the present invention is the provision of a chemical distribution system for a commercial laundry which can be inexpensively manufactured from readily obtainable materials and standard parts, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a chemical distribution system having a pressure tank containing a body of chemical and a pocket of air trapped in its upper portion and having a pump whose inlet is connected to a source of chemical and whose outlet is connected to the lower portion of the pressure tank. A motor is connected to the pump and a control is connected on the one hand to the pressure tank to receive an indication of the pressure in the body of air and is connected on the other hand to the motor to energize it when the air pressure falls below a predetermined value.

More specifically, the source of chemical is a drum containing a body of chemical resting on a spring-supported platen which issues a signal when the weight of the drum falls below a predetermined value. A pressure conduit is connected on one end to the lower part of the pressure tank and at the other end to a plurality of secondary conduits, each leading to a washing machine.

BRIEF DESCRIPTION OF THE DRAWINGS

The character of the invention, however, may be best understood by reference to one of its structural forms, as illustrated by the accompanying drawing, in which:

The single FIGURE of drawings shows somewhat schematically a chemical distribution system incorporating the principles of the present invention.

DESCRIPTION OF THE PREFERRED EMBODIMENT

Referring to the drawing, the chemical distribution system, indicated generally by the reference numeral 10, is shown as having a pressure tank 11 containing a body 12 of chemical such as soap, which does not completely fill the tank, so that a pocket of air 13 resides in the upper part of the tank. A gear-type pump 14 (which maintains priming and does not allow air in the system) is provided with an inlet 15, which is connected to a source 16 of chemical and has its outlet 17 connected to the lower end of the pressure tank 11. A motor 18 has its output shaft connected through a clutch 21 to the input drive shaft of the pump 14. A control 22 is connected on the one hand by a conduit 23 to the upper part of the pressure tank to receive a signal proportional to the pressure in the air pocket 13 and is connected on the other hand by wires to the motor 18 to energize it when the air pressure falls below a predetermined value.

In the preferred embodiment, the control 22 is provided with an expandible bellows 26 having a finger 27 which moves with it vertically and engages on occasion a switch 28; the switch, when engaged, connects a source 29 of electrical power to the motor 18 through wires 24.

The source 16 of chemical is a drum 31 containing a body 32 of chemical, such as soap, resting on a platen 33 which is supported on springs 34. This platen issues a signal when the weight of the drum falls below a predetermined value. The platen, when supporting a full drum, rests on the switch 35 which is normally open. This means that, when the platen 33 rises, the switch closes and connects a source 37 of electrical power to a lamp when lit indicating that the drum 31 is close to empty and needs to be changed.

A pressure conduit 38 is connected on one end to the lower part of the pressure tank 11 and at the other end to a plurality of secondary conduits 39, each leading to a washing machine 41. Each secondary conduit 39 contains a shut-off valve 42 and an orifice 43.

The inlet 15 of the pump 14 is connected to the drum 31 of chemical by a conduit 44 containing a check valve 45. The conduit is clear in the drawing and extends downwardly into the drum 31 to a point adjacent the bottom.

A branch conduit 46 is connected from the pressure conduit 38 to the source 16 of chemical and the branch conduit contains a pressure relief valve 47 to return chemical to the source if the pressure in the pressure conduit 38 exceeds a predetermined value.

The pressure tank 11 is of an elongated cylindrical shape mounted on the floor with the largest dimension horizontal. The pump 14 and the motor 18 are mounted on the upper surface of the pressure tank.

In the preferred embodiment, the chemical in the body 32 is soap and the conduit 44 which leads to the pressure tank and the branch conduit 46 for returning chemical are connected to the drum by a quick-release means, including a union 51 to permit replacement of the drum to take place readily. Portions of the conduit are permanently associated with the cover 50 of the drum which, in turn, is connected to the drum proper by a clamping band 48.

A pressure gage 25 is connected to the body 13 of air in the pressure tank 11 to indicate the pressure at any given time and the control 22 is provided with a dial 52 for setting the value of predetermined value of air pressure. A limiting value is also indicated by a lamp 49.

The operation of the invention will now be readily understood in view of the above description. The drum 31 which has been filled with the soap or other chemical in a body 32 is mounted in place on the platen 33. The connections are completed by means of the clamping band 48 and the pipe union 51. The pressure control 22 senses that the air pressure in the body 13 is lower than a predetermined value and it, therefore, energizes the motor 18, which in turn drives the pump 14 through the shaft 19 and the clutch 21. The pump sucks chemical from the body 32 through the check valve 45 and pumps it into the lower portion of the pressure tank 11. At that time the air in the body 13 is pressed upwardly and compressed. The gage 25 indicates an increase in air pressure and the same pressure is felt in the pressure control 22. The dial 52 is set to the predetermined pressure value and this makes an adjustment in the position of the bellows 26 and the finger 27 in the well-known manner, thus requiring greater or lesser pressure to contact the switch 28 to operate the motor 18. The increase in pressure in the body 13 of air causes a similar increase in pressure on the body 12 of chemical residing in the pressure tank and this pressure is felt through the pressure conduit 38. In order to cause flow of chemical into the washing machine 41, it is simply necessary to open one of the valves 42 to allow the flow to take place. If more than one valve 42 is open, then the flow to the various washing machines is regulated by the size of the orifice 43 which resides in its particular branch conduit 39. If the pressure exceeds the desirable value in the conduit 38, flow will take place through the regulating valve 47 and will return chemical to the body 32 in the drum 31. When the weight of the body 32 of chemical in the drum falls below a predetermined value, this is indicated by the non-contact of the platen 33 with the switch 35, the movement of the drum being possible due to the use of flexible portions in the conduits 44 and 46 which allow a certain degree of vertical motion of the drum. The fact that the chemical in the drum is low is indicated by the lamp 36 in time for the operator to exchange the drum for a new full drum. He can do this quickly because of the quick release means inherent in the use of the union 51 and the clamping band 48 and he is able to select a time when none of the washing machines will be requiring a further supply of chemical.

The advantages of the present invention will be clearly appreciated from the above description. Chemical is available at each of the washing machines at any given time and this chemical is available at a substantial pressure. Any number of washing machines can be simultaneously served, the maximum number, of course, being regulated by the specific design of the apparatus and particularly the capacity of the pump 14. It can be seen that the apparatus is simple in construction and lends itself to a long life of useful service with a minimum of maintenance. The use of a corrosive chemical will not result in any of the apparatus being rendered inoperative. It should be noted that the sensitive portions of the apparatus (including the bellow 26 and associated equipment) are free of the chemical and are subjected only to the pressure in the body of air 13. Furthermore, any portion of the apparatus that fails can be readily removed without any substantial length of downtime.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Chemical distribution system, comprising:

(a) a drum containing a body of chemical, (b) a spring-support platen for supporting the drum which issues a signal when the weight of the drum falls below a predetermined value, (c) a pressure tank containing a body of chemical and a pocket of air trapped in its upper portion above the body, (d) a supply conduit, one end of which is connected to the lower portion of the pressure tank and the other end extends downwardly in the drum, (e) a rotary pump connected to the supply conduit for pumping chemical from the drum to the pressure tank, (f) a motor connected to the pump, (g) a control connected on one hand to the pressure tank above the body of chemical to receive an indication of pressure of the pocket of air and connected on the other hand to the motor for energizing it when the pressure in the pocket of air falls below a predetermined value, (h) a pressure conduit connected on one end to the lower part of the pressure tank and at the other end to a plurality of secondary conduits, each leading to a washing machine, and (i) a branch conduit from the pressure conduit to the supply conduit between the drum and the check valve, the branch conduit containing a pressure relief valve to return chemical to the drum if the pressure in the pressure conduit exceeds a predetermined value.

2. Chemical distribution system as recited in claim 1, wherein the control consists of an expandible bellows having a finger that moves with it and engages a switch which, when engaged, connects a source of electrical power to the motor.

3. Chemical distribution system as recited in claim 1, wherein each secondary conduit contains a shut-off valve and an orifice.

4. Chemical distribution system as recited in claim 1, wherein the pressure tank is of an elongated cylindrical shape mounted with the longer dimension horizontal, and wherein the pump and the motor are mounted on the upper surface of the pressure tank.

5. Chemical distribution system as recited in claim 1, wherein the chemical is soap and wherein a conduit leading to the pump and a branch conduit are connected to the drum by quick-release means to permit replacement of the drum to take place readily.

6. Chemical distribution system as recited in claim 1, wherein a pressure gage is connected to the body of air in the pressure tank to indicate the pressure at any time, and wherein the control is provided with a dial for setting the value of predetermined value of air pressure.

* * * * *